US008297493B2

(12) United States Patent
Kudray

(10) Patent No.: US 8,297,493 B2
(45) Date of Patent: Oct. 30, 2012

(54) MAIL BOX FLAG THAT FITS ON TO THE FRONT OF THE MAIL BOX

(76) Inventor: Gary Dean Kudray, Bedford, TX (US)

( * ) Notice: Subject to any disclaimer, the term of this patent is extended or adjusted under 35 U.S.C. 154(b) by 0 days.

(21) Appl. No.: 12/927,725

(22) Filed: Nov. 23, 2010

(65) Prior Publication Data

US 2012/0125991 A1 May 24, 2012

(51) Int. Cl.
*A47G 29/14* (2006.01)

(52) U.S. Cl. ..... 232/34

(58) Field of Classification Search ..... 232/34, 232/35, 17, 45; 116/307, 309–313, 315, 116/319, 320
See application file for complete search history.

(56) References Cited

U.S. PATENT DOCUMENTS

| | | | | | |
|---|---|---|---|---|---|
| 2,856,123 | A | * | 10/1958 | Mary | 232/35 |
| 3,270,956 | A | | 9/1966 | Mullner | |
| 3,648,924 | A | | 3/1972 | Burns | |
| 3,709,189 | A | * | 1/1973 | Widham | 232/35 |
| 4,344,559 | A | | 8/1982 | Widham | |
| 4,363,439 | A | * | 12/1982 | Manian | 232/35 |
| 4,365,740 | A | | 12/1982 | Whitley et al. | |
| 4,488,677 | A | * | 12/1984 | Guest, Sr. | 232/34 |
| 4,655,390 | A | * | 4/1987 | Martin | 232/35 |
| 4,708,286 | A | * | 11/1987 | Norris | 232/35 |
| 4,756,472 | A | | 7/1988 | Hammons | |
| 5,082,170 | A | | 1/1992 | Goss | |
| 5,119,986 | A | | 6/1992 | Kobilarcik et al. | |
| 5,366,148 | A | | 11/1994 | Schreckengost | |
| 5,388,759 | A | * | 2/1995 | Barnes | 232/35 |
| 5,524,818 | A | * | 6/1996 | Patry et al. | 232/35 |
| 5,634,589 | A | * | 6/1997 | Greene | 232/35 |
| 6,053,404 | A | | 4/2000 | Jefferson | |
| 6,371,367 | B1 | | 4/2002 | Otero | |
| 6,425,521 | B1 | * | 7/2002 | Cooper | 232/34 |
| 6,575,357 | B1 | | 6/2003 | Rundell | |
| 7,337,945 | B1 | | 3/2008 | Riggs | |

* cited by examiner

*Primary Examiner* — William L. Miller
(74) *Attorney, Agent, or Firm* — Mark W Handley

(57) ABSTRACT

A mail box flag assembly for use on common mail boxes having a hinged front door in front. The flag assembly mounts on the front of the hinged front mail box door consisting of a detachable flag (that can be customized to provide house numbers, or themed logos). The flag is attached to a rotating arm that rests on a raised slotted bracket when not in use. When in use (indicating mail is contained in the mailbox for delivery by the postal carrier) the arm is rotated on a rod outward (perpendicular to the mail box door) slides downward until it fits into a raised slotted bracket that holds the flag arm in place so a postal carrier can see the extended flag and know that mail is contained in the mail box for delivery.

3 Claims, 4 Drawing Sheets

MAIL BOX FLAG THAT FITS ON TO THE FRONT OF THE MAIL BOX

TECHNICAL FIELD OF THE INVENTION

The present invention relates in general to mail box flags, and in particular to a mail box flag mounted on the front of a mail box.

BACKGROUND OF THE INVENTION

Outdoor mail boxes typically have mail box flags attached to the side and are raised and lowered to indicate mail is contained in the mail box to be delivered. Often times mail boxes are bricked in making it hard to attach a mail box flag to the side. This invention eliminates the side mail box use and attaches to the front of the mail box and more readily seen by the passing postal carrier. Further, the flag can be detached and various themes or house can be used to add a distinctive decoration to the mail box.

SUMMARY OF THE INVENTION

A flag assembly to be mounted on the front of a common mail box. A flag, a flag arm, a rod on which the flag arm rotates, and raised slotted brackets for keeping the flag arm in place in use or not in use, and a back plate are together called the flag assembly and are secured to the mail box door by adhesive or by screws using pre-drilled holes in the back plate. The flag is attached to the flag arm which rests in a slot on the top of the assembly when not in use and perpendicular to the mail box door in a slot located further down on the assembly when in use. The slotted brackets are designed to keep the flag arm stationary for either use. The mail box flag and it's assembly is designed to notify the postal carrier that mail is in the mail box and needs to be delivered. This is indicated when the flag is extended perpendicular to the mail box door.

DESCRIPTION OF THE DRAWINGS

For a more complete understanding of the present invention and the advantages thereof, reference is now made to the following description taken in conjunction with the accompanying Drawings in which

FIG. 1 is a front, elevation view of a mail box showing a mail box flag unit that fits onto the front of the mail box;

FIG. 2 is front view of a back plate for the mail box flag unit;

FIG. 3 is side elevation view of the mail box flag unit; and

FIG. 4 is front elevation view of the flag, flag arm and rod of the mail box flag unit.

DETAILED DESCRIPTION OF THE INVENTION

The present invention relates to a mail box flag that fits on to the front of the mail box.

Figure 1:
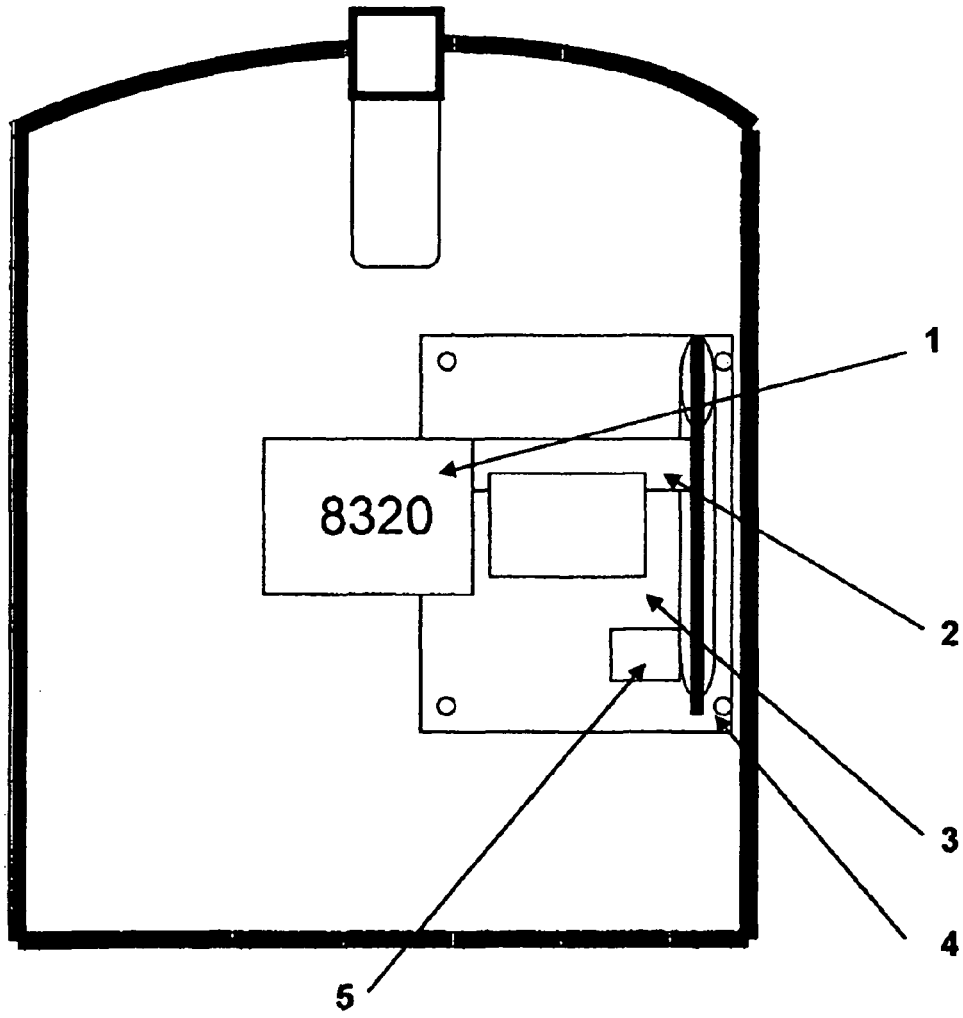
FIGS. 1 through 4 show various aspects for mail box flag that fits on to the front of the mail box made according to the present invention, as set forth below.
Figure 2:
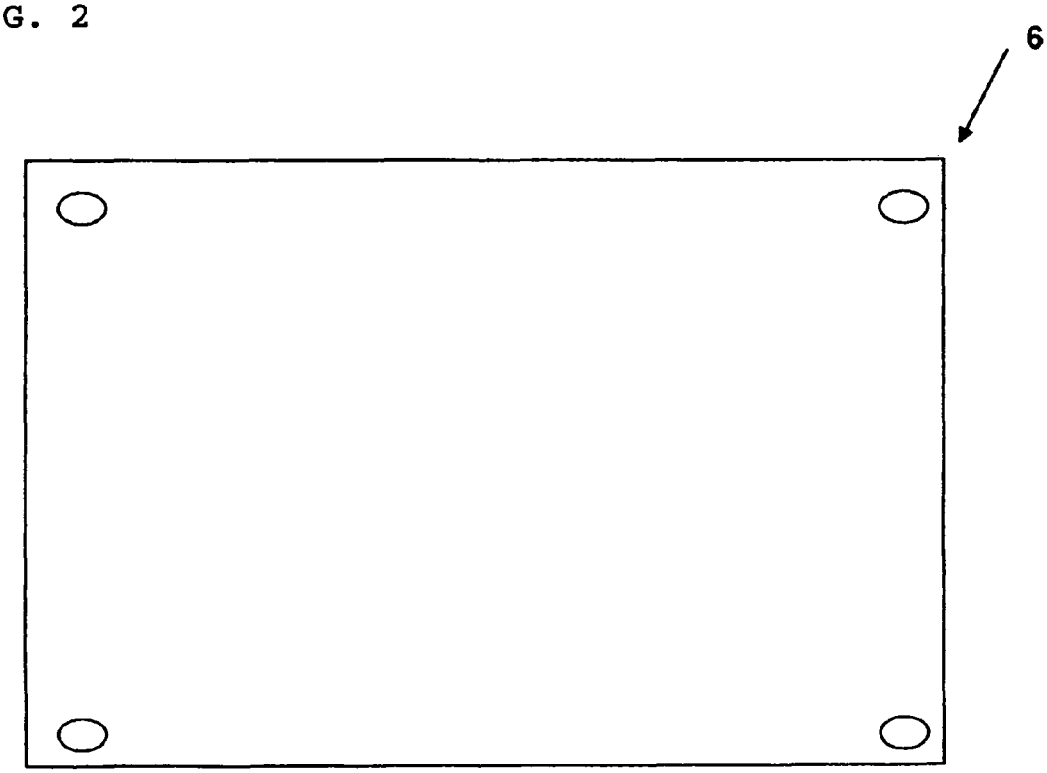
Figure 3:
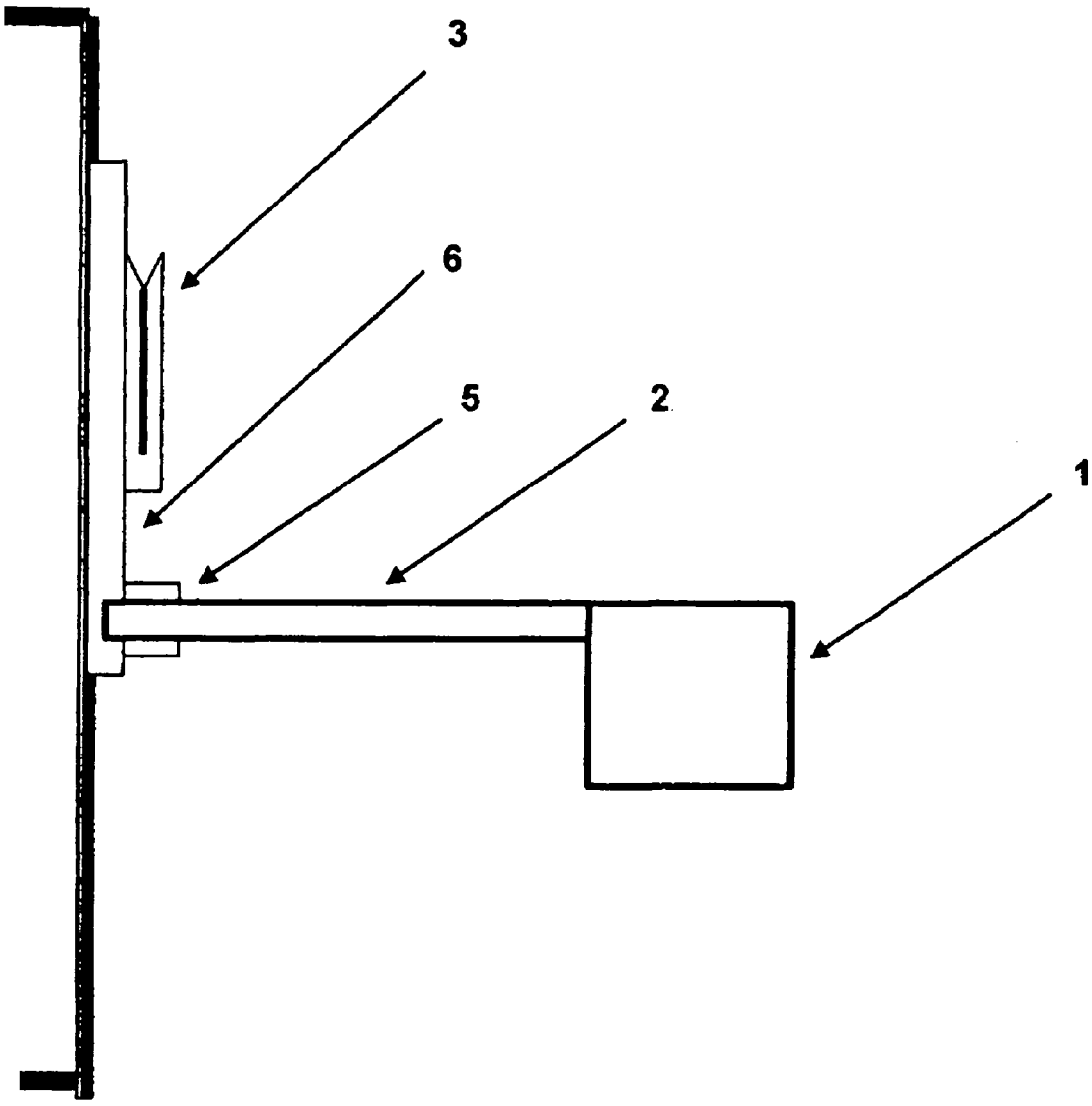
Figure 4:
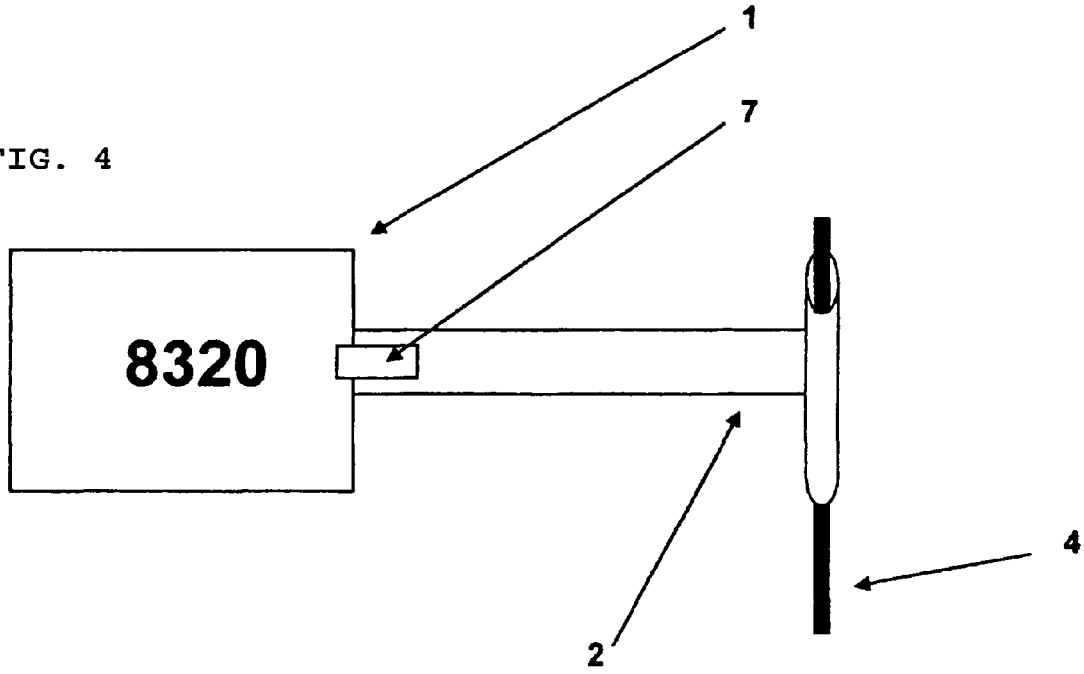

Referring to FIGS. 1-4, the device is comprised of the following:

Detachable flag 1 that can come with various colors, numbers or themes.

Flag arm support 2 with appropriate sleeve that will allow the support arm 2 to slide up and down a rod 4.

Bracket 3 to hold flag arm 2 when not in use.

Rod 4 to facilitate the support arm 2 for sliding the flag 1 up and down.

Raised plastic or metal lip 5 to keep the flag 1 from folding back.

Back plate 6 with predrilled holes for attachment to the front of the mail box.

Snap 7 to affix flag to flag support arm.

Detachable flag 1 that attaches to the support arm snap 7 and flag support arm 2.

Flag support arm 2 with a hole in the end that allows it to slide up and down a rod 4.

Bracket 6 (made of appropriate material) that attaches to the front of the mail box. It can be appropriately attached using screws or adhesive. It will have the following attachments: Sliding rod 4; Bracket 3 to hold flag support arm 2; Raised bracket 5 to keep flag 1 from folding back; and Bracket 3 to hold flag support arm 2.

Mail box back plate 6 has pre-attached hardware bracket 3 to hold flag support arm 2 when flag is not in use, fixed rod 4 for flag support arm 2 to slide up and down on, and raised lip 5 to keep flag 1 from folding back when extended.

After installation of the back plate 6 the flag 1 attached to a snap 7 can be installed to the flag support arm 2.

The flags unit 1 is detachable so other flags with various decorations (logos, motifs, etc) can be readily attached To indicate that a mail box contains mail the flag 1 and flag support arm 2 would be lifted off the bracket 3 and extended perpendicular to the mail box front. The flag support arm 2 would be slid down the rod 4 until it reaches a position where it can be held by the raised bracket 5 so it cannot be blown back against the mail box and will remain extended.

When the mail carrier comes to the mail box all he/she needs to do is slide the flag support arm up and return it to its flag arm support bracket 3.

Normal mail box flags are attached to the side of the mail box. This is smaller and attaches to the front of the mail box.

It allows for the mail box flag to be attached to the front of the mail box and not the side in case the mail box is enclosed in brick or other ornamental facing.

Prior art mail box flags are attached to the side of the mail box. Often mail boxes have brick around them making the flag harder to attach and unsightly. The mail box flag of the present application will attach to the front of the mail box and stick out approximately three inches when the flag is extended. The flags are attached to an arm and are detachable so ornamental, season, school logos flags can be ready attached for decoration.

Although the preferred embodiment has been described in detail, it should be understood that various changes, substitutions and alterations can be made therein without departing from the spirit and scope of the invention as defined by the appended claims.

What is claimed is:

1. A mail box flag that fits on to a front door of the mail box, comprising:

a flag;

a back plate secured to the front door of the mail box;

a rod mounted in fixed relation to said back plate and extending in a generally vertical direction;

a flag arm having a first end to which said flag is secured and a second end having a tubular shape to define a hole for receiving said rod such that said flag arm is slidable along said rod in said generally vertical direction, and pivotably moveable from a first position with said flag arm and said flag disposed adjacent to the front door of the mail box to a mail indicating second position with said flag arm and said flag extending outward from the front door of the mail box;

a raised lip fixed to said back plate and disposed adjacent to said rod, said raised lip positioned for preventing said flag arm from moving from said mail indicating second position to said first position; and a bracket fixed to said back plate for receiving said flag arm and holding said flag arm in said first position.

2. The mail box flag according to claim 1, wherein said flag is detachably secured to said flag arm.

3. The mail box flag according to claim 1, wherein said back plate is mounted to the front door of the mail box with one of an adhesive and screws.

* * * * *